US005476756A

United States Patent [19]

Chari et al.

[11] Patent Number: 5,476,756

[45] Date of Patent: Dec. 19, 1995

[54] COLOR PHOTOGRAPHIC ELEMENT WITH IMPROVED RESISTANCE TO THERMAL AND PHOTOCHEMICAL YELLOWING

[75] Inventors: Krishnan Chari, Rochester; Wendell F. Smith, Fairport; Sundaram Krishnamurthy, Penfield, all of N.Y.

[73] Assignee: Eastman Kodak Company, Rochester, N.Y.

[21] Appl. No.: 257,584

[22] Filed: Jun. 8, 1994

Related U.S. Application Data

[63] Continuation-in-part of Ser. No. 431, Jan. 4, 1993.

[51] Int. Cl.[6] ..... G03C 11/00

[52] U.S. Cl. ..... 430/372; 430/435; 430/512; 430/551; 430/554; 430/555; 430/558

[58] Field of Search ..... 430/505, 502, 430/551, 546, 531, 554, 555, 558, 512, 607, 434, 372, 374, 375, 376, 377, 386, 387, 435, 931

[56] References Cited

U.S. PATENT DOCUMENTS

| | | | |
|---|---|---|---|
| 4,239,851 | 12/1980 | Aoki et al. | 430/546 |
| 4,540,657 | 9/1985 | Krishnamurthy | 430/546 |
| 4,745,052 | 5/1988 | Renner | 430/555 |
| 4,900,655 | 2/1990 | Nakazyo et al. | 430/546 |
| 5,001,045 | 3/1991 | Furutachi et al. | 430/545 |
| 5,037,730 | 8/1991 | Aoki et al. | 430/551 |
| 5,047,315 | 9/1991 | Morigaki et al. | 430/544 |
| 5,183,731 | 2/1993 | Takahashi et al. | 430/551 |
| 5,200,307 | 4/1993 | Takahashi | 430/546 |

FOREIGN PATENT DOCUMENTS

| | | |
|---|---|---|
| 0435179A2 | 12/1990 | European Pat. Off. . |
| 0472153 | 2/1992 | European Pat. Off. . |
| 0471347 | 2/1992 | European Pat. Off. . |
| 0476604 | 3/1992 | European Pat. Off. . |
| 2432041 | 1/1975 | Germany . |
| 62-131259 | of 0000 | Japan . |
| 51-003219 | 6/1974 | Japan . |
| 62-075449 | 9/1985 | Japan . |
| 62-080641 | 10/1985 | Japan . |
| 62-129853 | 11/1985 | Japan . |
| 62-201441 | 2/1986 | Japan . |
| 62-166331 | 7/1986 | Japan . |
| 62-075448 | 4/1987 | Japan . |
| 63-250652 | 10/1988 | Japan . |

OTHER PUBLICATIONS

Anonymous. *Research Disclosure,* Item No. 308119 (Dec. 1989), pp. 993–1015, England, Kenneth Mason Publications Ltd.

*Primary Examiner*—Charles L. Bowers, Jr.
*Assistant Examiner*—Geraldine Letscher
*Attorney, Agent, or Firm*—Andrew J. Anderson

[57] ABSTRACT

Yellowing of a processed photographic element is inhibited by incorporating a scavenger compound capable of reacting with magenta coupler, e.g. an epoxy compound, in a layer adjacent a layer containing the magenta coupler. At least one of these layers contains a solubilizing agent for the scavenger compound. In preferred embodiments, the processing solution used to process the photographic element contains an external solubilizing agent for the scavenger compound, preferably benzyl alcohol.

9 Claims, No Drawings

COLOR PHOTOGRAPHIC ELEMENT WITH IMPROVED RESISTANCE TO THERMAL AND PHOTOCHEMICAL YELLOWING

This application is a continuation in part of copending application Ser. No. 08/000,431 filed Jan. 14, 1993, pending the entire disclosures of which are incorporated herein by reference.

FIELD OF THE INVENTION

This invention relates to a silver halide based color photographic element containing dye forming couplers, more specifically to the incorporation of a scavenger compound for residual magenta coupler in such an element, and to a method of improving the resistance to yellowing of a processed color photographic element.

BACKGROUND OF THE INVENTION

It is well known that thermal and photochemical yellowing are major problems in image stability of color prints. It is also known that yellowing is caused by decomposition of residual magenta coupler (i.e. coupler that has not reacted to form dye) on exposure of the print to light and/or to heat and humidity. Over the years significant improvement in thermal and photochemical yellowing has been achieved by introducing magenta couplers that are less prone to yellowing. However, there still exists a need to further improve the position with respect to yellowing in color paper.

It has been suggested that certain epoxy compounds are able to undergo reaction with residual magenta couplers and thereby effectively prevent both thermal and photochemical yellowing since the products of the reaction are not yellow and are not prone to yellowing. See for example U.S. Pat. No. 4,540,657 to Krishnamurthy and Japanese Patent Publication No. 62-131259 to Fuji Photo Film Co., Ltd. The incorporation of sparingly soluble epoxy compounds into photographic elements for other purposes is also disclosed in the art. See for example U.S. Pat. No. 4,900,655 to Nakazyo and European Patent Publication No. 471,347 to Tomiyama. However, attempts to incorporate such compounds in a photographic element in the manner suggested in the art to prevent yellowing have resulted in a loss of color density in the print. There is therefore a need to devise a method for inhibiting the thermal and photochemical yellowing in color prints without reducing the color density of the print.

SUMMARY OF THE INVENTION

One aspect of this invention comprises a multilayer color photographic element comprising a support having coated thereon:

(a) a photosensitive first layer comprising
  (i) a silver halide emulsion and
  (ii) a magenta coupler dispersed therein; and (b) a second layer comprising a scavenger compound capable of reacting with the magenta coupler to produce a product which is resistant to yellowing;

wherein at least one of said layers contains a pH dependent solubilizing agent capable of dissolving the scavenger compound at a pH above about 8.

The scavenger compound is preferably an epoxy compound. The second layer is preferably adjacent the first layer. The first layer can be positioned between and adjacent to the second layer and a third layer which also contains a scavenger compound capable of reacting with the magenta coupler to produce a product which is resistant to yellowing.

Another aspect of this invention comprises a method of improving the resistance to yellowing of a color photographic element after processing, which method comprises (A) exposing a photographic element to light to produce a desired latent image thereon, said element comprising a support having coated thereon:
  (a) a photosensitive first layer comprising
    i)an aqueous silver halide emulsion and
    ii) a magenta coupler dispersed therein, and
  (b) a second layer which comprises a scavenger compound capable of reacting with the magenta coupler to produce a product which is resistant to yellowing;

wherein at least one of said layers contains a pH dependent solubilizing agent for the scavenger compound capable of solubilizing the scavenger compound at a pH above about 8; and (B) processing the element after exposure with a processing solution having a pH above about 8.

The processing solution preferably contains an external solubilizing agent for the scavenger compound. The scavenger compound is preferably an epoxy compound. The second layer is preferably adjacent the first layer. The first layer can be positioned between and adjacent to the second layer and a third layer which also contains a scavenger compound capable of reacting with the magenta coupler to produce a product which is resistant to yellowing.

A processed photographic element of this invention is resistant to thermal and photochemical yellowing yet retains the color density of a comparable photographic element which does not contain a scavenger compound, such as an epoxy compound. While not wishing to be bound by any theory, it is believed that the loss of color density of the print when an epoxy compound is incorporated into the photographic element in accordance with the prior art is due to reaction of the epoxy compound with the magenta coupler during storage of the element prior to processing. This results in less dye being formed during processing and, consequently, loss of color density in the print. In accordance with this invention, premature reaction of the magenta coupler and epoxy compound is inhibited by placing these components in different layers in the element. The presence of the pH dependent solubilizing agent solubilizes the epoxy compound permitting it to migrate into the layer containing the magenta coupler during processing. It then reacts with the residual magenta coupler to inhibit yellowing in the resulting print upon exposure to light and/or to heat and humidity over an extended period of time.

DETAILED DESCRIPTION OF THE INVENTION

The photographic element of this invention comprises a support having coated thereon a photosensitive first layer comprising a magenta coupler and a second layer comprising a scavenger compound. It is to be understood that the color photographic element further comprises a plurality of layers and that the first and second layers may be positioned wherever desired in the multilayer structure. The plurality of layers can include one or more additional magenta coupler containing layers, one or more layers containing the scavenger compound in addition to other layers conventionally present in color photographic elements. The support can be, for example, cellulose acetate, a synthetic polymer such as polyethylene terephthalate, or paper.

The photosensitive first layer comprises a silver halide emulsion containing dispersed therein a magenta coupler. Silver halide emulsions and magenta couplers are well known. See for example Research Disclosure 308,119 dated December 1989, the disclosure of which is incorporated herein by reference.

The magenta dye forming coupler is preferably a pyrazolone, pyrazolotriazole, pyrazolobenzimidazole with or without a suitable leaving group. The magenta coupler can be monomeric, dimeric, trimeric, oligomeric or polymeric coupler wherein the coupler moiety can be attached to the polymeric backbone via a substituent on the coupler moiety or a substituent on a coupling off group. Illustrative magenta couplers are disclosed in, for example, U.S. Pat. Nos. 1,969,479; 2,311,082; 2,343,703; 2,369 ,489; 2,575,182; 2,600,788; 2,706,685; 2,908,573; 3,061,432; 3 062,653; 3,152,896; 3,153,816; 3,214,437; 3,253,924; 3 311,476; 3,419,391; 3,519,429; 3,725,067; 3,770,447; 3 907,571; 3,928,044; 3,935,015; 4,120,723; 4,123,281; 4 199,361; 4,336,325; 4,351,897; 4,385,111; 4,401,752; 4 407,936; 4,413,054; 4,283,472; 4,338,393; 4,420,556; 4 443,536; 4,500,630; 4,522,915; 4,540,654; 4,576,912; 4,581,326; 4,621,046; 4,728,598; 4,774, 172; and 4,853 ,319 European Patent Applications Nos. 2 84,239; 284,24 0; 240,852; 170,164; and 177,765; Japanese Patent Publication Nos. 60/170854, 60/194451 and 60/194 452 and Great Britain Patents Nos. 1,047,612, 1,357,372 and 1,530,272, and "Farbkuppler-eine Literaturübersicht", published in Agfa Mitteilungen, Band III, pp 126–156 (1961); the disclosures of which are incorporated herein by reference.

Magenta dye-forming couplers comprise pyrazolone compounds of the general formulae:

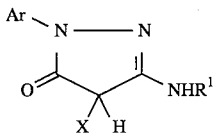

(M-1)

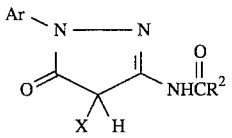

(M-2)

pyrazolotriazole compounds of the general formulae:

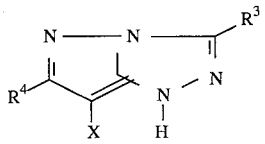

(M-3)

and

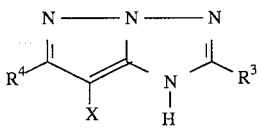

(M-4)

and pyrazolobenzimidazoles of the formula:

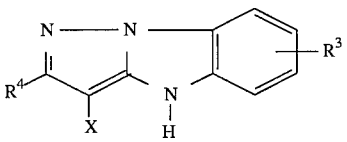

(M-5)

wherein

Ar is an unsubstituted aryl group or an aryl group (including pyridyl) substituted with one or more substituents selected from halogen atoms and cyano, alkylsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl, and trifluoromethyl, or Ar is an aryl group substituted with a group which forms a link to a polymeric chain;

$R^1$ is a substituted or unsubstituted phenyl group and $R^2$ is a substituted or unsubstituted alkyl or phenyl group, the $R^1$ and $R^2$ substituents being individually selected from halogen atoms, and alkyl, aryl, alkoxy, aryloxy, carbonamido, carbamoyl, sulfonamido, sulfamoyl, alkylsulfinyl, arylsulfinyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, provided that $R^1$ and $R^2$ each contain at least 6 carbon atoms or the $R^1$ and $R^2$ substitutents may individually comprise a group which forms a link to a polymeric chain;

$R^3$ and $R^4$ are individually selected from the group consisting of hydrogen, substituted and unsubstituted alkyl, substituted and unsubstituted phenyl, substituted and unsubstituted alkoxy, substituted and unsubstituted amino, substituted and unsubstituted anilino, substituted and unsubstituted acylamino, halogens and a group which links to a polymer, provided that the total number of carbon atoms contained in $R^3$ and $R^4$ is at least 6 if neither $R^3$ nor $R^4$ is a group which links to a polymer; and X is hydrogen or a coupling-off group selected from the group consisting of halogens, alkoxy, aryloxy, alkylthio, arylthio, acyloxy, sulfonamido, carbonamido, arylazo, nitrogen-containing heterocyclic and imido groups. Coupling-off groups are well known to those skilled in the photographic art. Generally, such groups determine the equivalency of the coupler and modify the reactivity of the coupler. Coupling-off groups can also advantageously effect the layer in which the coupler is coated or other layers in the photographic material by performing, after release from the coupler, such functions as development inhibition, bleach acceleration, color correction, development acceleration and the like. Representative coupling-off groups include, as noted above, halogens (for example, chloro), alkoxy, aryloxy, alkyl thio, aryl thio, acyloxy, sulfonamido, carbonamido, arylazo, nitrogen-containing heterocyclic groups such as pyrazolyl and imidazolyl, and imido groups such as succinimido and hydantoinyl groups. Except for the halogens, these groups may be substituted if desired. Coupling-off groups are described in further detail in: U.S. Pat. Nos. 2,355,169; 3,227,551; 3,432,521; 3,476,563; 3,617,291; 3,880,661; 4,052,212 and 4,134,766, and in British Patent References Nos. 1,466,728; 1,531,927; 1,533,039; 2,006,755A and 2,017,704A, the disclosures of which are incorporated herein by reference.

Preferred structures of magenta couplers are 4-or 2-equivalent pyrazolone couplers, particularly couplers of the structure:

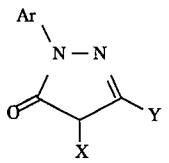

(M-6)

wherein:

Ar is selected from the group consisting of unsubstituted aryl groups, substituted aryl groups and substituted pyridyl groups, the substituents being selected from the group consisting of halogen atoms and cyano, alkylsulfonyl, arylsulfonyl, sulfamoyl, sulfamido, carbamoyl, carbonamido, alkoxy, acyloxy, aryloxy, alkoxycarbonyl, aryloxycarbonyl, ureido, nitro, alkyl and trifluoromethyl groups;

Y is an anilino group substituted with one or more substituents selected from the group consisting of halogen atoms, and alkyl, aryl, alkoxy, aryloxy, carbonamido, carbamoyl, sulfonamido, sulfamoyl, alkylsulfinyl, arylsulfinyl, alkylsulfonyl, arylsulfonyl, alkoxycarbonyl, aryloxycarbonyl, acyl, acyloxy, ureido, imido, carbamate, heterocyclic, cyano, hydroxyl groups, and groups which form a link to a polymeric chain, and wherein Y contains at least 6 carbon atoms; and X is a coupling-off group selected from the group consisting of halogen, alkoxy, aryloxy, alkylthio, arylthio, acyloxy, sulfonamido, sulfonyloxy, carbonamido, arylazo, nitrogen-containing heterocyclic and imido groups.

Coupling-off groups are well known to those skilled in the photographic art. Generally, such groups determine the equivalency of the coupler and modify the reactivity of the coupler. Coupling-off groups can also advantageously effect the layer in which the coupler is coated or other layers in the photographic material by performing, after release from the coupler, such functions as development inhibition, bleach acceleration, color correction, development acceleration and the like. Representative coupling-off groups include, as noted above, halogens (for example, chloro), alkoxy, aryloxy, alkylthio, arylthio, acyloxy, sulfonamido, carbonamido, arylazao, nitrogen-containing heterocyclic groups such as pyrazolyl and imidazolyl, and imido groups such as succinimido and hydantoinyl groups. Coupling-off groups are described in further detail in: U.S. Pat. Nos. 2,355,169; 3,227,551; 3,432,521; 3,476,563; 3,67,291; 3,880,661; 4,052,212 and 4,134,766, and in British Patent Reference Nos. 1,466,788; 1,531,927; 1,533,039; 2,006,755A and 2,017,704A, the disclosures of which are incorporated herein by reference.

Particularly preferred are compounds in which Ar is of the structure:

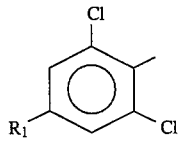

wherein $R_1$ is selected from the group consisting of halogen, cyano, alkylsulfonyl, arylsulfonyl, sulfamoyl, sulfonamido, carbamoyl, carbonamido, ureido, alkoxycarbonyl, aryloxycarbonyl, acyloxy, alkoxy, aryloxy, nitro and trifluoromethyl groups;

Y is of the structure:

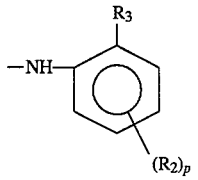

wherein p is from zero to 2 and each $R_2$ is in a meta or para position with respect to $R_3$;

each $R_2$ is individually selected from the group consisting of halogen, alkyl, alkoxy, aryloxy, carbonamido, carbamoyl, sulfonamido, sulfamoyl, alkylsulfinyl, arylsulfinyl, alkylsulfonyl, arylsulfonyl, alkoxycarbonyl, aryloxycarbonyl, acyloxy, ureido, imido, carbamate, heterocyclic, cyano, nitro, acyl, trifluoromethyl, alklythio and carboxyl groups; and $R_3$ is selected from the group consisting of hydrogen, halogen, alkyl, alkoxy, aryloxy, alkylthio, carbonamido, carbamoyl, sulfonamido, sulfamoyl, alkylsulfonyl, arylsulfonyl, alkoxycarbonyl, acyloxy, acyl, cyano, nitro and trifluoromethyl groups; and X is of the structure:

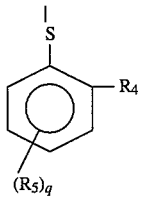

wherein $R_4$ and $R_5$ are individually selected from the group consisting of hydrogen, halogen, alkyl, alkoxy, aryloxy, carbonamido, ureido, carbamate, sulfonamido, carbamoyl, sulfamoyl, acyloxy, alkoxycarbonyl, aryloxycarbonyl, amino and carboxyl groups, and wherein q is 0, 1 or 2 and $R_5$ may be in the meta or para position with respect to the sulfur atom.

Suitable magenta dye-forming couplers for use in the compositions and methods of the present invention include, but are not limited to, the following compounds:

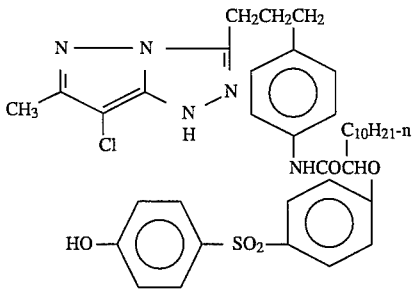

(M-7)

-continued
(M-8)
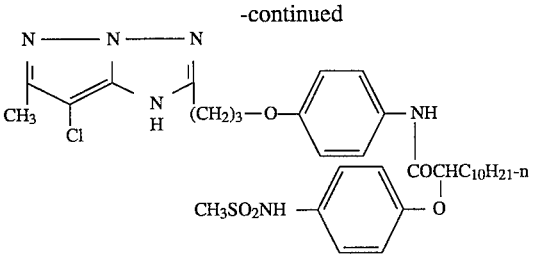
(M-9)
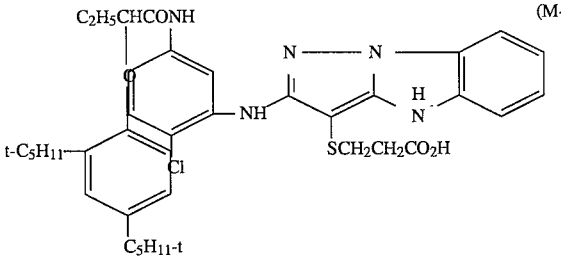
(M-10)
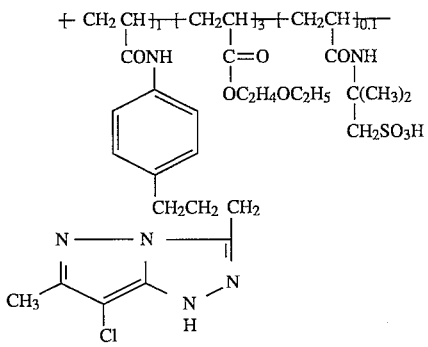
(M-11)
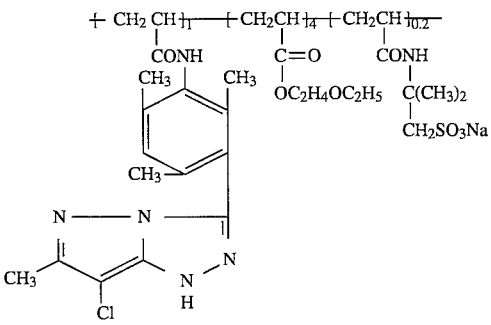
(M-12)
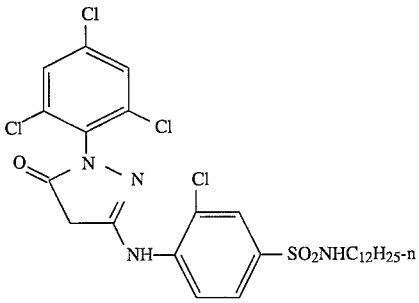
-continued
(M-13)
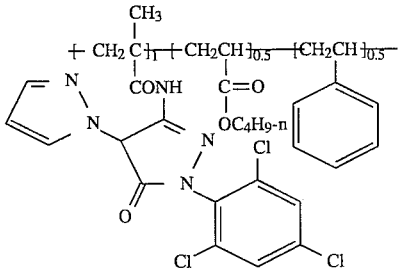
(M-14)
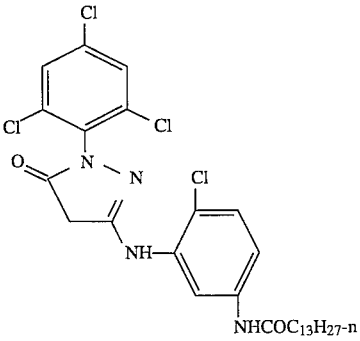
(M-15)
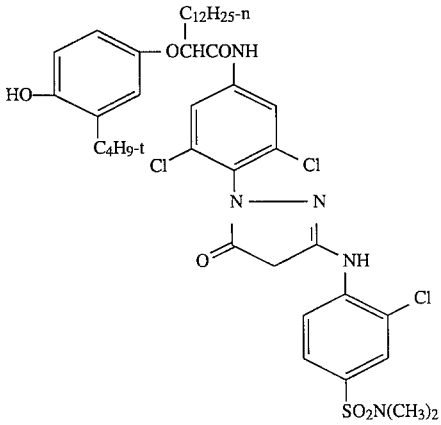
(M-16)
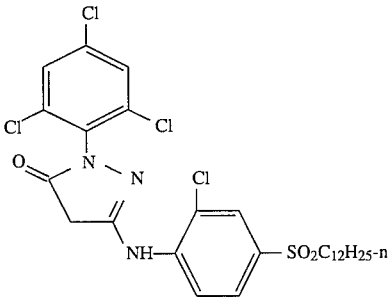

-continued
(M-17)
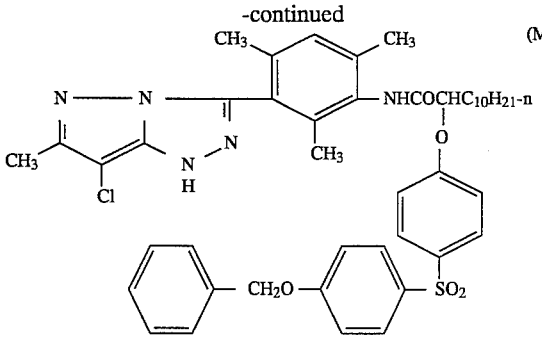
(M-18)
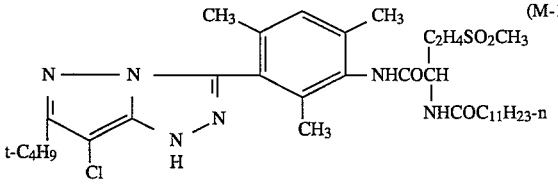
Examples of two-equivalent 3-anilino pyrazolone dye-forming magenta couplers suitable for use in the coupler compositions of the present invention include, but are not limited to the following:
(M-19)
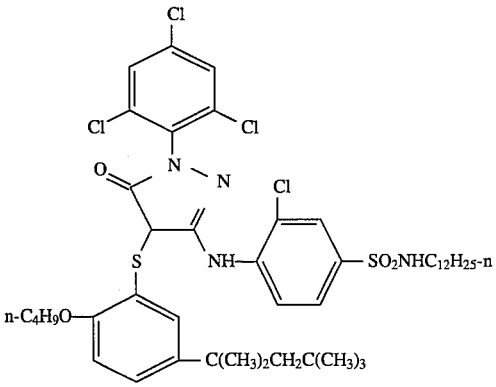
(M-20)
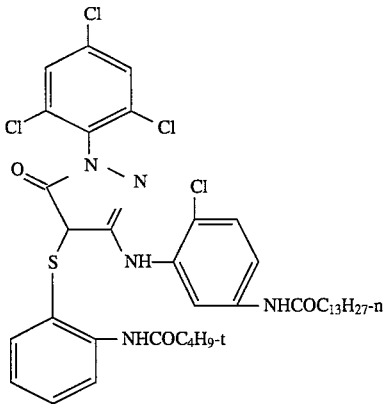
-continued
(M-21)
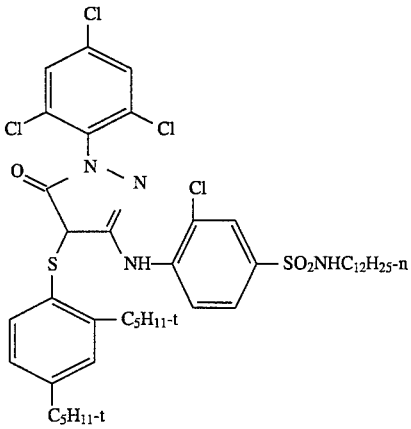
(M-22)
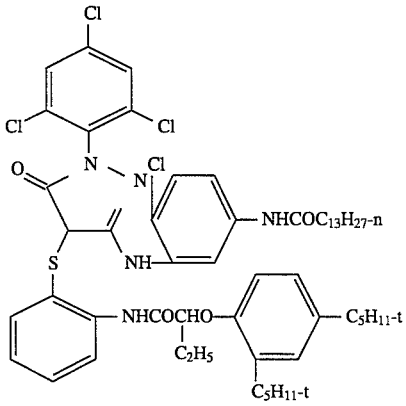
(M-23)
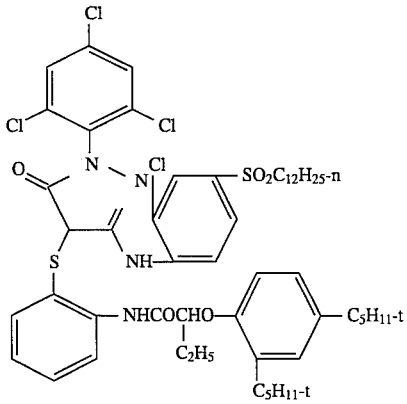
(M-24)
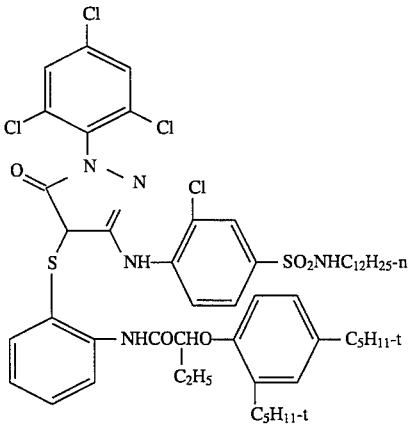

-continued
(M-25)
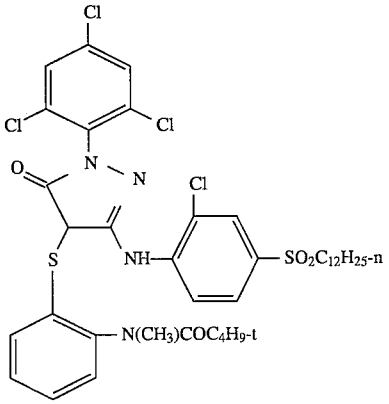
(M-26)
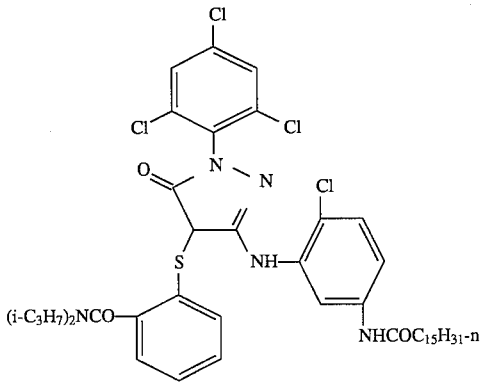
(M-27)
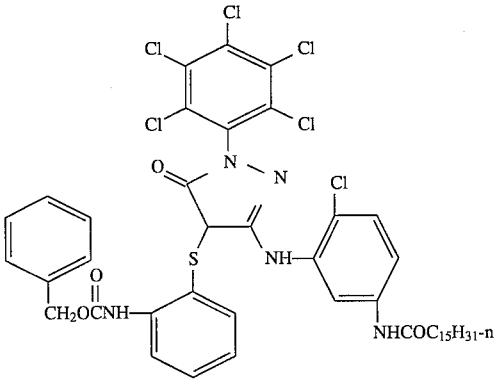
(M-28)
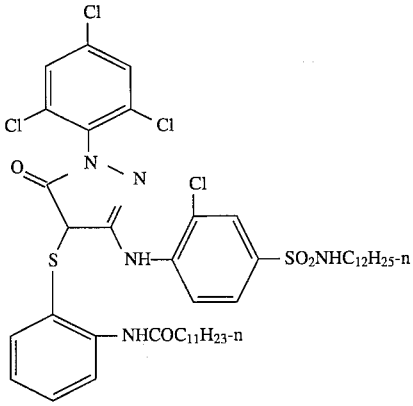
-continued
(M-29)
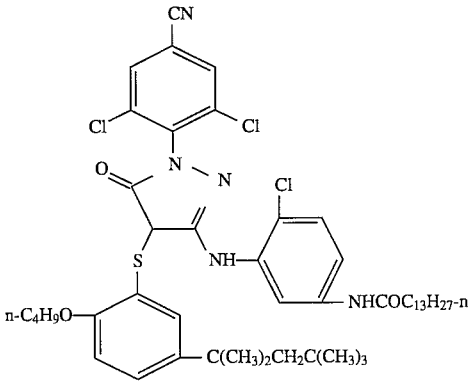
(M-30)
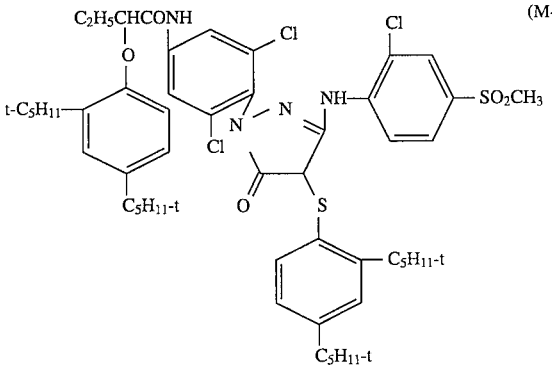
(M-31)
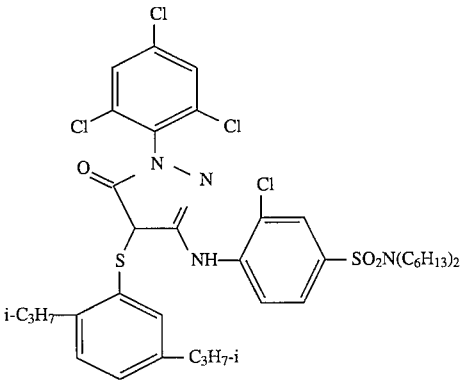
(M-32)
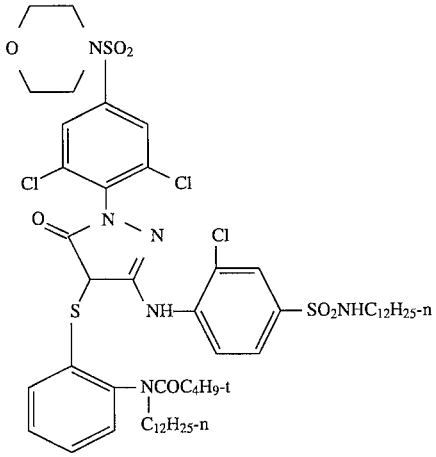

-continued
(M-33)
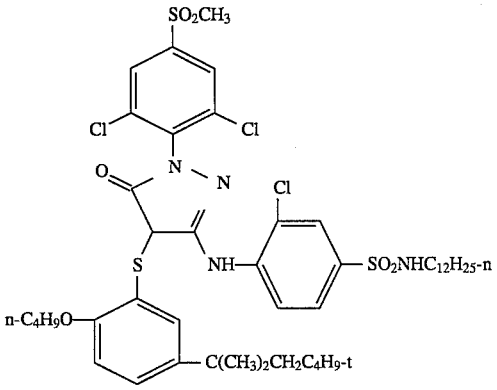
(M-34)
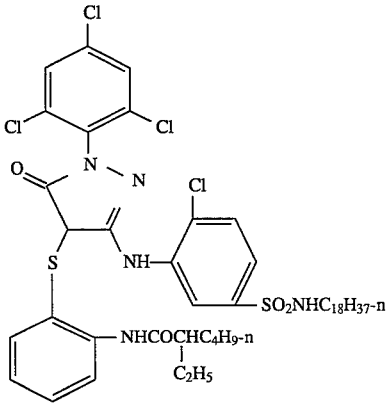
(M-35)
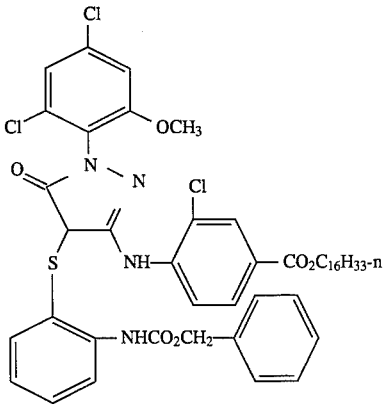
(M-36)
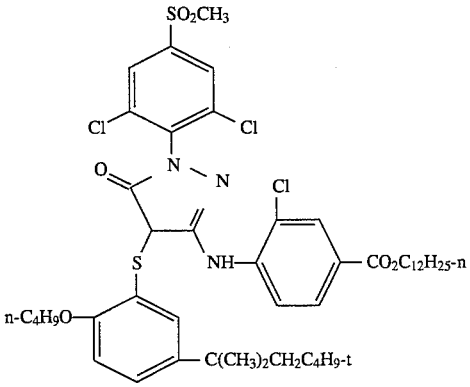
-continued
(M-37)
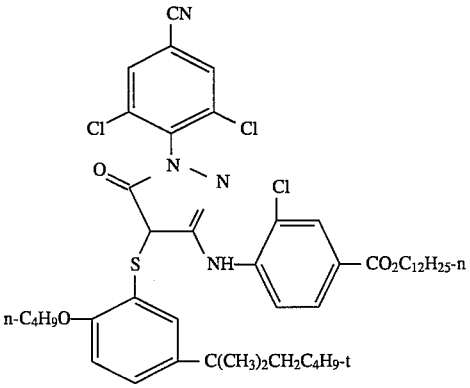
(M-38)
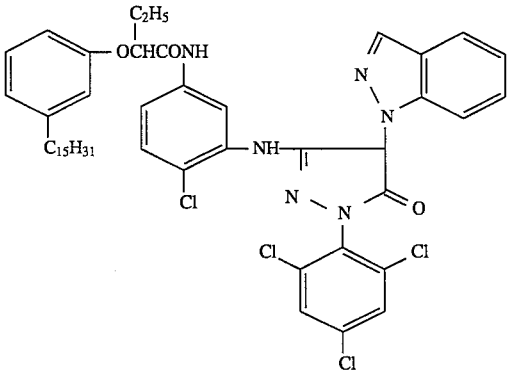
(M-39)
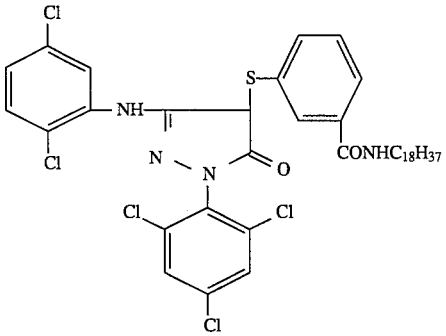
(M-40)
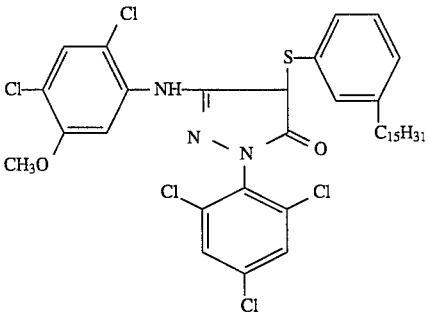

Particularly preferred couplers are the compounds of the formulae:

(M-23)

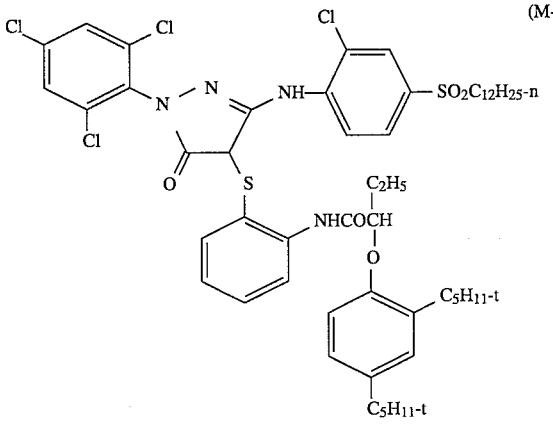

(M-21)

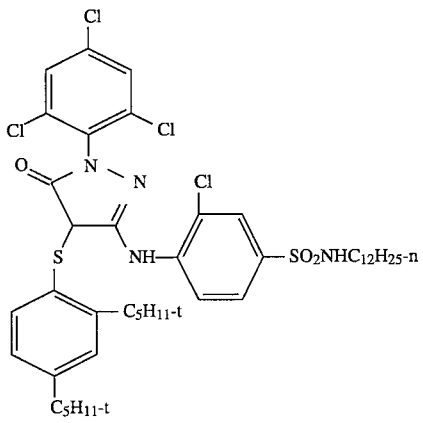

(M-22)

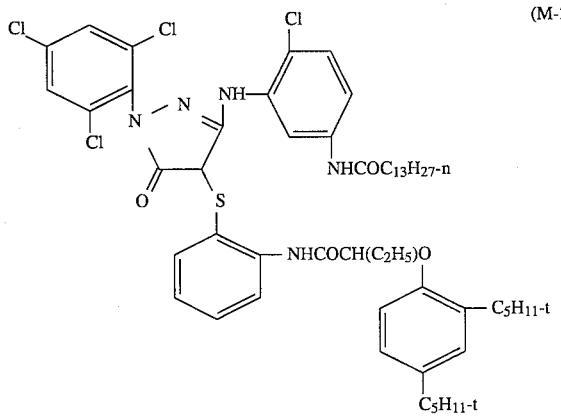

(M-20)

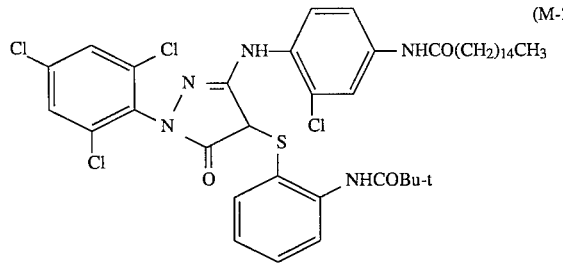

In accordance with this invention, a scavenger compound capable of reacting with the magenta coupler is incorporated into a second layer which is, preferably, adjacent to the first layer. Placing the scavenger compound and the magenta coupler in separate layers inhibits premature reaction between the scavenger compound and the coupler. In a preferred embodiment, the first layer can be positioned between and adjacent to the second layer and a third layer which also contains a scavenger compound capable of reacting with the magenta coupler to produce a product which is resistant to yellowing. At least one of these layers contains a pH dependent solubilizing agent, as described more fully below.

The scavenger compound capable of reacting with the magenta coupler is preferably an epoxy compound. Preferred epoxy compounds are of the structure:

(S-1)

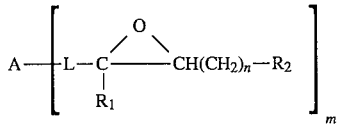

where A is a polyvalent, an acidic oxide group, a carboxylic group, a heterocyclic moiety, a carbocyclic group, or an alkane or substituted alkane group;

each L is at least one divalent linking group;

$R_1$ and $R_2$ are each independently selected from H, alkyl, cycloalkyl, aryl, heterocyclic and ester;

n is a positive integer with a range of 1 to 30—with the proviso that when n is 0, $R_2$ is H;

m is a positive integer of at least one, with the proviso that at least one A, L, $R_1$ or $R_2$ contains at least one ester or amide group derived from an acidic oxide of carbon, phosphorus, sulfur, boron or silicon.

Preferred epoxy compounds are terminal epoxy compounds described in U.S. Pat. No. 4,540,657 to Krishnamurthy, the entire disclosures of which are incorporated by reference. These preferred epoxy compounds are of the structure:

(S-2)

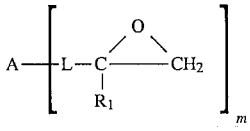

where A, L and $R_1$ are as defined above.

A particularly preferred epoxy compound has the structure:

(S-3)

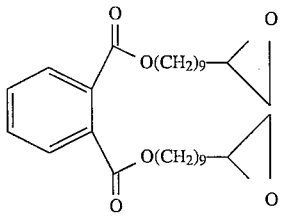

The objectives of the invention are realized by preparing separate dispersions of the scavenger compound and the magenta coupler and incorporating the scavenger compound in the photographic element in at least one layer that is separate but, preferably, adjacent to the photosensitive layer containing the magenta coupler.

A compound capable of solubilizing the scavenger compound at a pH above about 8, but not at lower pH values, is incorporated into at least one of the layers containing the magenta coupler or the scavenger compound. This compound is referred to herein as a pH dependent solubilizing agent. The layers can be coated onto the support together with other layers as desired by conventional techniques. Typically, the first layer comprises a silver halide emulsion in which the silver halide grains have been sensitized to green light and in which droplets of magenta coupler dissolved in an appropriate solvent, for example dibutyl phthalate or tricresyl phthalate, are dispersed. An auxiliary solvent, such as ethyl acetate or the like can be used in the preparation of the dispersion and then removed.

The second layer comprises an aqueous dispersion containing droplets of the scavenger compound. In accordance with this invention, a solubilizing agent for the scavenger compound is incorporated in the dispersed droplets in either or both of the layers. As noted above, the solubilizing agent solubilizes the scavenger compound at a pH above about 8, preferably above about 9. The solubilizing agent may be any hydrocarbon compound containing a hydrocarbon chain of eight or more carbon atoms and an acid functionality, such as carboxyl or sulfonamide. Included in this are fatty acids, ethoxy carboxylates and sarcosinates. The solubilizing agent is preferably a long chain fatty acid, such as myristic acid or palmitic acid. The solubility of the scavenger compound in a medium containing 0.01M of the solubilizing agent and 0.01M of sodium chloride, 10% v/v n-propanol and 90% v/v water should be not more than 1 μg/ml at pH 5 and not less that 20.0 μg/ml at pH 10.

The solubilizing agent may be present in an amount of about 1 to about 35% by weight based on the total weight of the oil phase in a dispersion after removal of the auxiliary solvent, if present.

In preferred embodiments of the invention, the first layer, that is the magenta coupler containing layer also contains an image stabilizer. Image stabilizers are disclosed in Research Disclosure 308,119 (December 1989) in Section VII, subsection J, which is incorporated by reference. Particularly preferred are compounds I-1 and I-2 set forth below.

I-1

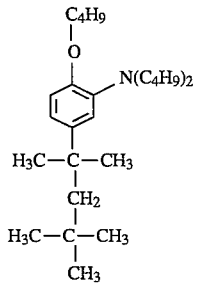

I-2

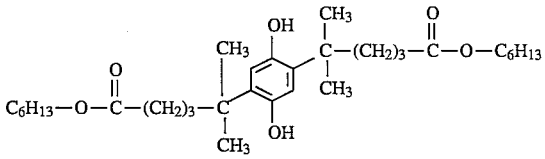

In certain embodiments of the invention, a ultraviolet absorbing compound can be incorporated in the second layer. Illustrative ultraviolet absorbing compounds are disclosed in Research Disclosure 308,119 (December 1989) in Section VIII, subsection C, which is incorporated herein by reference. Particularly preferred are compounds UV-1 and UV-2 set forth below.

UV-1

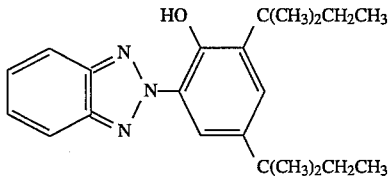

UV-2

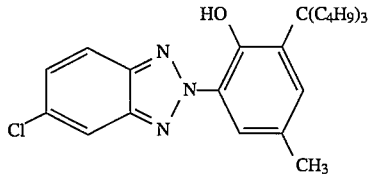

The photographic element is processed using a standard developer composition. A typical developer composition comprises an aqueous solution containing a developing agent, such as a p-phenylene diamine, for example, 4-N-ethyl-N-(2-methanesulphonamidoethyl)amino-o-toluidine, an accelerator such as sodium hydroxide a preservative such as sodium sulfite, a restrainer such a potassium bromide and various stabilizers and other additives. A discussion of processing compositions can be found in Research Disclosure 308,119, December 1989, and references mentioned therein. The entire Research Disclosure is incorporated herein by reference.

Preferably, the developer composition contains a compound capable of solubilizing the scavenger compound (referred to herein as "external solubilizing agent"). The external solubilizing agent is a water miscible organic compound, preferably an alcohol, more preferably an aromatic alcohol, such as benzyl alcohol. The developer composition preferably contains the external solubilizing compound in an amount of about 0 to about 5%, more preferably about 0.5 to about 3.5%, the percentages being by volume, based on the volume of the developer composition.

The following examples illustrate the invention.

EXAMPLE 1 (COMPARATIVE)

Preparation of Dispersion (A):

A dispersion of the magenta coupler M-20 was prepared in the following manner:

3.7 g of the coupler was combined with 3.7 g of the solvent SOLI (tricresyl phosphate) and 45g of ethyl acetate to constitute the oil phase. The aqueous phase was prepared by combining 47.2 g of a 12.5% w/w solution of Type IV gelatin with 5.9 g of a 10% w/w solution of the surfactant Alkanol XC (commercially available from DuPont) and 59.5g of distilled water. The aqueous phase was then combined with the oil phase and the mixture was passed three times through a colloid mill to obtain the dispersion. The ethyl acetate was then removed from the dispersion by evaporation at 60° C. and reduced pressure.

Preparation of Dispersion (B):

A dispersion of the scavenger compound S-3 was prepared in the following manner:

9 g of S-3 was combined with 45 g of ethyl acetate to constitute the oil phase. The aqueous phase was prepared by combining 48 g of a 12.5% w/w solution of Type IV gelatin with 6 g of a 10% w/w solution of Alkanol XC and 12 g of distilled water. The aqueous phase was then combined with the oil phase and the mixture was passed three times through a colloid mill. The ethyl acetate was then removed from the dispersion by evaporation at 60° C. and reduced pressure.

Portions of dispersion (A) and dispersion (B) were mixed together, combined with a green sensitized silver chloride emulsion and coated as a photosensitive layer on a paper support to give coverage of 23 mg/ft$^2$ S3, 32.8 mg/ft$^2$ M-20, 16 mg/ft$^2$ Ag and 100 mg/ft$^2$ gelatin in a photosensitive layer as shown in Table I below. An overcoat layer was applied over the photosensitive layer. The required amount of hardener was added to the overcoat just prior to coating.

TABLE I

| | |
|---|---|
| Overcoat | 130 mg/ft$^2$ gelatin |
| Photosensitive layer | |
| Paper support | |

EXAMPLE 2 (INVENTION)

Dispersions (A) and (B) prepared in Example 1 were applied to a paper support in separate layers. In this case the photosensitive layer contained only the green sensitized silver chloride emulsion and the coupler M-20. The scavenger compound S-3 was coated in a separate layer above the photosensitive layer as shown in Table II below:

TABLE II

| | |
|---|---|
| Overcoat | 130 mg/ft$^2$ gelatin |
| | 23 mg/ft$^2$ S-3 |
| | 130 mg/ft$^2$ gelatin |
| | 32.8 mg/ft$^2$ M-20 |
| | 16 mg/ft$^2$ Ag |
| | 100 mg/ft$^2$ gelatin |
| Paper support | |

Coated strips from Example 1 and Example 2 were allowed to harden and then exposed and processed in the same way. Processing was done using the standard RA-4 process (commercially available from the Eastman Kodak Company, Rochester, N.Y.). Additional strips from Example 1 and Example 2 were stored at room temperature for four weeks prior to exposure and processing to examine the effect of raw stock keeping on sensitometry. The results are shown in FIG. 1 and FIG. 2. FIG. 1 shows fresh sensitometry and FIG. 2 shows sensitometry after four weeks of raw stock keeping. It is clear that the invention offers significant advantages in terms of raw stock keeping.

EXAMPLE 3

Preparation of Dispersion (C):

A dispersion of the magenta coupler M-20 was prepared using the following procedure:

5.7 g of M-20 was combined with 5.7 g of SOLI and 50.5 g of ethyl acetate to constitute the oil phase. The aqueous phase was prepared by combining 76 g of a 12/5% w/w solution of Type IV gelatin with 9.5 g of a 10% w/w solution of Alkanol XC and 93.1 g of distilled water. The aqueous phase was combined with the oil phase and the mixture was passed three times through a colloid mill. The ethyl acetate was then removed from the dispersion by evaporation at 60° C. and reduced pressure.

Preparation of Dispersion (D):

A dispersion of the scavenger compound S-3 was prepared in the following manner.

1.875 grams of S-3 was combined with 16.88 grams of ethyl acetate to constitute the oil phase. The aqueous phase was prepared by combining 24 grams of a 12.5% w/w solution of Type IV gelatin with 3 grams of a 10% w/w solution of Alkanol XC and 46.1 grams of distilled water. The aqueous phase was combined with the oil phase and the mixture was passed three times through a colloid mill. The ethyl acetate was then removed from the dispersion by evaporation at 60° C. and reduced pressure.

Preparation of Dispersion (E):

Same as dispersion (D) except that the oil phase contained 0.562 g myristic acid in addition to the 1.875 g of S-3 and 16.88 g of ethyl acetate.

Preparation of Dispersion (F):

Same as dispersion (E) except that the oil phase contained 0.844 g myristic acid.

Preparation of Dispersion (G):

Same as dispersion (E) except that the oil phase contained 1.125 g myristic acid.

Coatings were made with dispersions C, D, E, F and G using the format shown in Table III below. These coatings contained an additional layer (not shown) which contained a dispersion for absorbing ultra-violet radiation. The emulsion used was the same as that used in Example 1 above. Formats a to d (see Table III) contained varying levels of myristic acid in the scavenger layer based on dispersions D, E, F and G, respectively.

TABLE III

| | | | |
|---|---|---|---|
| Gelatin overcoat | | | |
| 130 mg/ft$^2$ gelatin | | | |
| UV Protection Layer | | | |
| 124 mg/ft$^2$ gelatin | | | |
| format a | format b | format c | format d |
| 23,0 S-3 0.00 Myristic Acid (Dispersion D) | 23.0 S-3 6.89 Myristic Acid (Dispersion E) | 23.0 S-3 10.35 Myristic Acid (Dispersion F) | 23.0 S-3 13.8 Myristic Acid (Dispersion G) |
| Emulsion Layer | | | |
| 16.0 Ag | | | |
| 32.8 M-20 | | | |
| 100 gelatin | | | |
| (Dispersion C) | | | |
| Paper Support | | | |

All numbers refer to laydowns in mg/ft$^2$, unless otherwise noted.

Unexposed strips from the coatings were processed using the standard RA-4 process (control) and a modified RA-4 process wherein the RA-4 developer contained 3.2% v/v benzyl alcohol (invention). One set of strips were exposed to 50 Klux high intensity daylight (HID) radiation for two weeks and another set of strips were kept in a dark oven at 77° C. and 40% RH for four weeks. In each case the change in status A blue density was measured. The results are shown below in Tables IV and V.

TABLE IV

| Delta Blue After 2 Weeks 50 Klux HID Radiation | | |
|---|---|---|
| Format # | RA-4 (Control) | Modified RA-4 |
| a | 0.14 | 0.12 |
| b | 0.14 | 0.08 |
| c | 0.15 | 0.07 |
| d | 0.15 | 0.05 |

TABLE V

| Delta Blue After 4 Weeks 77° C., 40% RH Dark Keeping | | |
|---|---|---|
| Format # | RA-4 (Control) | Modified RA-4 |
| a | 0.26 | 0.14 |
| b | 0.27 | 0.14 |
| c | 0.26 | 0.14 |
| d | 0.26 | 0.13 |

EXAMPLE 4

Dispersions of the magenta coupler M-20 and the scavenger compound S-3 were prepared using procedures similar to that described above for dispersion C and dispersion F, respectively, in Example 3. The dispersions were then coated in the formats shown in Table VI below:

TABLE VI

| format e | format f | format g |
|---|---|---|
| Photosensitive Layer<br>32.8 M-20 75 GEL<br>16 Ag<br>Scavenger Layer<br>23 S-3 50 GEL<br>SUPPORT | Scavenger Layer<br>11.5 S-3 25 GEL<br>Photosensitive Layer<br>32.8 M-20 75 GEL<br>16 Ag<br>Scavenger Layer<br>11.5 S-3 25 GEL<br>SUPPORT | Photosensitive Layer<br>16.4 M-20 37.5 GEL<br>8 Ag<br>Scavenger Layer<br>23 S-3 50 GEL<br>Photosensitive Layer<br>16.4 M-20 37.5 GEL<br>8 Ag<br>SUPPORT |

Each of the formats contains the same amount of coupler, silver, scavenger compound and gelatin. In format (f) the photosensitive layer is sandwiched between two scavenger layers whereas in format (g) the scavenger layer is sandwiched between two photosensitive layers. Each format also contains a UV protection layer and a gelatin overcoat (not shown in Table VI).

Unexposed coatings based on each format were processed using the standard RA-4 process (control) and also a modified RA-4 process wherein the RA-4 developer contained 1.6% v/v benzyl alcohol. The strips were then analyzed for coupler content by high performance liquid chromatography (HPLC) along with a strip that had not been processed. The same strips were then analyzed for coupler content after 2 weeks storage at room temperature. The results are shown in Table VII.

TABLE VII

| | M-20 in raw stock | | M-20 in processed coating after 2 wks at rm temp | |
|---|---|---|---|---|
| Format | Fresh | 2 wk RT | RA-4 | mod. RA-4 |
| (e) | 32.7 | 32.4 | 32.1 | 15.6 |
| (f) | 32.4 | 30.4 | 29.3 | 6.2 |
| (g) | 32.1 | 31.4 | 29.6 | 11.1 |

It is clear that significantly greater post process elimination of the coupler M-20 is achieved using the sandwich arrangements (f) and (g). With arrangement (f) more than 80% of the residual coupler is eliminated in processed coatings after 2 weeks storage at room temperature; however, only 6% of the coupler is lost in unprocessed coatings under the same conditions.

Another set of processed coatings were stored at room temperature for two weeks and then exposed to 50 Klux high intensity daylight (HID) radiation for two weeks. The change in status A blue density as a result of exposure to radiation was then measured. The results are shown in Table VIII below:

TABLE VIII

| Delta Blue After 2 Weeks 50 Klux HID Radiation | | |
|---|---|---|
| Format # | RA-4 | Modified RA-4 |
| (e) | 0.11 | 0.09 |
| (f) | 0.09 | 0.02 |
| (g) | 0.09 | 0.05 |

These results show that this invention provides excellent image stability, particularly when the photosensitive layer is sandwiched between two scavenger layers and the developer solution contains 1.6% benzyl alcohol.

EXAMPLE 5

Dispersions of the magenta coupler M-20 and the scavenger compound S-3 were prepared in the following manner.

Dispersion of S-3

The oil phase was prepared by combining 3.75 grams of the scavenger compound with 1.7 grams of myristic acid in a 50 mL beaker. 60 grams of ethyl acetate was added and the solution was stirred on a hot plate for about five minutes.

The aqueous phase was prepared by combining 6.0 grams of Alkanol SC with 32 grams of a 12.5% w/w solution of Type IV gelatin in water. 56.5 grams of distilled water was then added and the solution was stirred on a hot plate for about five minutes.

The aqueous phase was combined with the oil phase and the mixture was stirred. The mixture was then passed three times through a colloid mill to obtain the dispersion. The ethyl acetate was removed by evaporation under reduced pressure.

Dispersion of M-20

The oil phase was prepared by combining 1.7 grams of M-20 with 1.7 grams of tricresyl phosphate and 11.5 grams of ethyl acetate. The solution was stirred for about ten minutes.

The aqueous phase was prepared by combining 2.5 grams of Alkanol XC with 20 grams of a 12.5% w/w solution of Type IV gelatin in water. 24.1 grams of distilled water was then added and the solution was stirred on a hot plate for about five minutes.

The aqueous phase was combined with the oil phase and the mixture was passed three times through a colloid mill to obtain the dispersion. The ethyl acetate was then removed by evaporation under reduced pressure.

The dispersions were then coated in formats d and e shown in Table IX below (the numbers indicate the amount of each component in mg/ft$^2$). The dispersion containing M-20 was mixed with the emulsion prior to coating.

TABLE IX

| format h | format i |
|---|---|
| 11.5 S-3 25 GEL<br>32.8 M-20<br>75 GEL<br>16 Ag<br>11.5 S-3 25 GEL | 25 GEL<br>32.8 M-20<br>75 GEL<br>16 Ag<br>25 GEL |

Each format also contains a UV protection layer and an overcoat (not shown). Format i (control) is the same as h (invention) except that it does not contain any scavenger compound.

Unexposed coatings based on each format were processed using the standard Kodak EP-2 process. A set of processed coatings were stored at room temperature for four weeks and then analyzed for coupler content by High Performance Liquid Chromatography (HPLC). A second set of processed coatings were held at room temperature for two weeks and then exposed to 50 Klux high intensity daylight radiation. Table X compares results obtain for format h (invention) and format i (control).

TABLE X

| | M-20 in raw stock | | M-20 in processed coating (after 4 wks at | |
|---|---|---|---|---|
| Format | Fresh | 4 wk RT | rm temp) | Delta Blue |
| h | 34.2 | 28.6 | 11.0 | 0.05 |
| i | 34.5 | 29.9 | 31.9 | 0.15 |

The values of M-20 indicate content in mg/ft$^2$.

It is clear that the method of the invention results in significant elimination of residual coupler after processing and this is reflected in improved image stability (column 4 of Table X shows the change in blue density in the coating after exposure to high intensity daylight radiation). Column 2 of Table X shows the amount of coupler in unprocessed coatings (raw stock) before and after storage at room temperature for four weeks. It is clear that the method of our invention is effective in preventing mixing of coupler and scavenger compound in unprocessed coatings.

EXAMPLE 6

Dispersions of the magenta coupler M-20 and the scavenger S-3 were prepared in the following manner:

Dispersion of S-3

The oil phase was prepared by combining 3.75 grams of the scavenger S-3 with 1.7 grams of myristic acid in a 50 mL beaker, 60 grams of ethyl acetate was added and the solution was stirred on a hot plate for about five minutes.

The aqueous phase was prepared by combining 6.0 grams of Alkanol XC with 32 grams of a 12.5% w/w solution of Type IV gelatin in water. 56.5 grams of distilled water was then added and the solution was stirred on a hot plate for about five minutes.

The aqueous phase was combined with the oil phase and the mixture was stirred. The mixture was then passed three times through a colloid mill to obtain the dispersion. The ethyl acetate was removed by evaporation under reduced pressure.

Dispersion of M-20

The oil phase was prepared by combining 1.7 grams of M-20 with 1.7 grams of SOL-2, 1.98 grams of I-1, 0.283 grams of I-2 and 11.5 grams of ethyl acetate. The solution was stirred for about ten minutes.

The aqueous phase was preparedly combining 2.5 grams of a 10% solution of Alkanol XC with 20 grams of a 12.5% solution of Type IV gelatin in water, 21.8 grams of distilled water was then added and the solution was stirred on a hot plate for about five minutes.

The aqueous phase was combined with the oil phase and the mixture was passed three times through a colloid mill to obtain the dispersion. The ethyl acetate was then removed by evaporation under reduced pressure.

Compounds identified as I-1, I-2, and SOL-2 have the following structures:

I-1

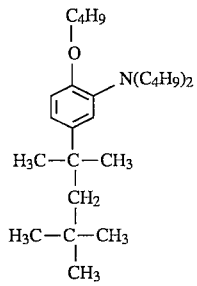

I-2

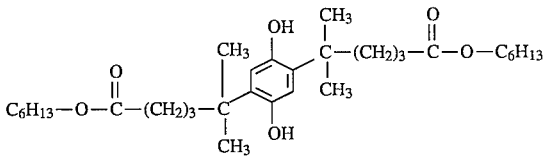

SOL-2

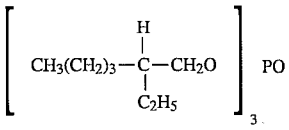

The dispersions were then coated in the formats shown below (the numbers indicate the amount of each component in mg/ft$^2$). The dispersion containing M-20 and the image stabilizers was mixed with the emulsion prior to coating.

| A<br>11.5 S-3<br>25 Gel | B<br>25 Gel |
|---|---|
| 32.8 M-20 | 32.8 M-20 |
| 38.2 I-1 | 38.2 I-1 |
| 5.5 I-2 | 5.5 I-2 |
| 16.0 Ag | 16.0 Ag |
| 75.0 Gel | 75.0 Gel |
| 11.5 S-3 | 25 Gel |
| 25 Gel | |

Each format also contains a UV protection layer and an overcoat (not shown). Format B (control) is the same as A except that it does not contain any scavenger.

Coatings based on each format were exposed using a 0–3 density 21 step tablet and a lB densitometer with a 3000 degree Kelvin tungsten lamp and Wratten 99 and 0.6 ND filters. The exposed coatings were processed using the standard Kodak EP-2 process. Processed coatings were held at room temperature for two weeks and then exposed to 50 Klux high intensity daylight (HID) radiation. Table I compares yellowing (change in blue Dmin) and dye fade (change in green Dmax) for A (invention; image stabilizers and scavenger) and B (control; image stabilizers only).

| | Blue Dmin | | Green Dmax | |
|---|---|---|---|---|
| Coating Plan | Fresh | After HID | Fresh | After HID |
| A | 0.06 | 0.10 | 2.47 | 2.16 |

-continued

| Coating Plan | Blue Dmin Fresh | Blue Dmin After HID | Green Dmax Fresh | Green Dmax After HID |
|---|---|---|---|---|
| B | 0.06 | 0.15 | 2.47 | 2.16 |

It is clear that the method of the invention using a combination of light stabilizers for the magenta image dye and a scavenger for residual magenta coupler achieves a reduction in yellowing (delta blue Dmin of 0.04 versus 0.09 for the control) while at the same time maintaining a good position with respect to dye fade.

EXAMPLE 7

Dispersions of M-20 and S-3 were prepared using procedures similar to those described in the previous example except that tricresyl phosphate was used as the permanent solvent for M-20 instead of SOL-2 and the oil phase of the coupler dispersion in this example did not contain any image stabilizers.

A dispersion containing UV absorbers was prepared using the following procedure. The oil phase was formulated by combining 85 grams of UV-1 with 15 grams of UV-2, 33.3 grams of SOL-3 and 11.4 grams of hydroquinone. The mixture was heated to 116° C. The aqueous phase was formulated by combining 70.8 grams of Type IV gelatin with 495.6 grams of water and 56.9 grams of a 10% w/w solution of Alkanol XC. The mixture was heated to 71° C. The oil phase was mixed with the aqueous phase and passed two times through a homogenizer to obtain the dispersion.

Compounds identified as UV-1, UV-2, and SOL-3 have the following structures:

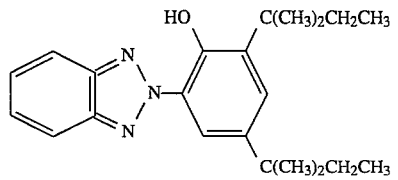

UV-1

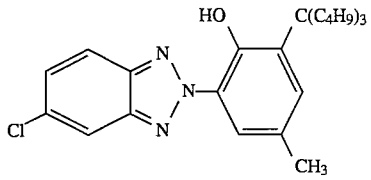

UV-2

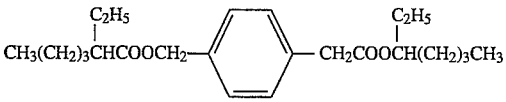

SOL-3

A separate dispersion of hydroquinone was prepared in the following manner. The oil phase was formulated by combining 100 grams of hydroquinone with grams of dibutylphthalate. The mixture was heated to 100° C. The aqueous phase was formulated by combining 150 grams of Type IV gelatin with 1050 grams of water and 35.9 grams of a 10% w/w solution of Alkanol XC. The mixture was heated to 52° C. The oil phase was combined with the aqueous phase and passed once through a homogenizer to obtain the dispersion.

Coating melts based on the above dispersions were prepared and coated on a paper support in the format shown below. The required amount of hardener was added prior to coating. The numbers refer to coverages in mg/ft$^2$.

| | |
|---|---|
| Overcoat | |
| Gelatin | 135.5 |
| UV Overcoat | |
| UV-1 | 25.5 |
| UV-2 | 4.5 |
| Hydroquinone | 3.4 |
| Gelatin | 124.0 |
| UV Layer | |
| UV-1 | 25.5 |
| UV-2 | 4.5 |
| Hydroquinone | 4.0 |
| Gelatin | 58.5 |
| S-3 | 48.0 |
| Magenta Imaging Layer | |
| Ag | 16.0 |
| Gelatin | 118.0 |
| M-20 | 32.8 |
| Interlayer | |
| Hydroquinone | 8.75 |
| Gelatin | 70.0 |
| S-3 | 48.0 |
| SUPPORT | |

A control coating containing no S-3 was also made. Unexposed strips from each coating were processed in RA-4 developer containing 1.6% v/v benzyl alcohol and then stored at room temperature. The strips were analyzed for residual coupler as a function of time. A set of unprocessed strips were stored at room temperature for the same length of time to check for reaction between coupler and S-3 in raw stock. The results are as follows:

| | M-20 Remaining in MG/FT2 | | | |
|---|---|---|---|---|
| | Raw Stock | | Processed | |
| | after 2 wk RT | after 4 wk RT | after 2 wk RT | after 4 wk RT |
| with S-3 | 29.5 | 29.6 | 9.1 | 7.8 |
| control | 30.3 | 29.2 | 30.9 | 30.4 |

It is clear that the amount of coupler in unprocessed coatings (raw stock) remains the same even after 4 weeks at room temperature and is comparable to what is found in the control. In processed coatings about 75% of the residual coupler is eliminated in the same period of time. It therefore is clear that it is possible to achieve selective elimination of residual magenta coupler in a multilayer color photographic element without altering the basic structure of the element. In this case the scavenger compound S-3 was incorporated in the existing UV layer and interlayer on either side of the magenta imaging layer.

The invention has been described in detail with particular reference to preferred embodiments thereof, but it is to be understood that variations and modifications can be effected within the spirit and scope of the invention.

What is claimed is:

1. A multilayer color photographic element comprising a support having coated thereon:

(a) a first layer comprising
  (i) a silver halide emulsion and
  (ii) a magenta coupler dispersed therein; and (b) a second layer comprising a scavenger compound capable of reacting with the magenta coupler to produce a product which is resistant to yellowing; wherein at least one of said layers contains a pH dependent solubilizing agent capable of dissolving the scavenger compound at a pH above about 8, but not at lower pH values; and wherein said first layer is adjacent said second layer.

2. A photographic element according to claim 1, wherein said first layer further comprises at least one image stabilizer.

3. A photographic element according to claim 2, wherein the image stabilizer is selected from the group consisting of compounds of the formulas:

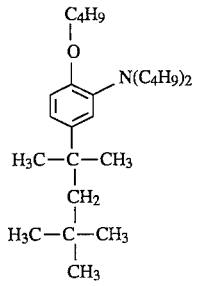

and

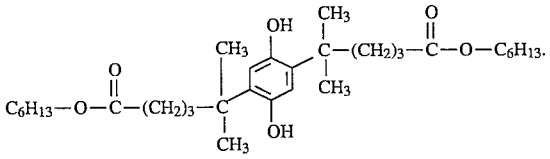

4. A photographic element according to claim 1, wherein said second layer further comprises at least one ultraviolet absorbing compound.

5. A photographic element according to claim 4, wherein said ultraviolet absorbing compound is selected from the group consisting of compounds having the formulas:

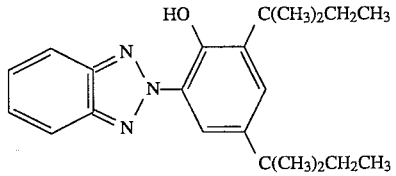

and

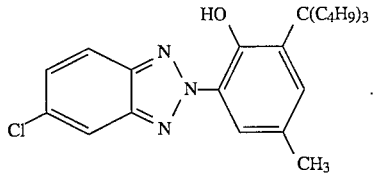

6. A method of improving the resistance to yellowing of a color photographic element after processing, which method comprises (A) exposing a photographic element to light to produce a desired latent image thereon, said element comprising a support having coated thereon:
  (a) a first layer comprising
    i) an aqueous silver halide emulsion and
    ii) a magenta coupler dispersed therein, and
  (b) a second layer which comprises a scavenger compound capable of reacting with the magenta coupler to produce a product which is resistant to yellowing;

wherein at least one of said layers contains a pH dependent solubilizing agent for the scavenger compound capable of solubilizing the scavenger compound at a pH above about 8, but not at lower pH values; and wherein said first layer is adjacent said second layer; and (B) processing the element after exposure with a developer solution having a pH above about 8.

7. A method in accordance with claim 6, wherein the developer solution contains an external solubilizing agent.

8. A method in accordance with claim 7, wherein the external solubilizing agent is an aromatic alcohol.

9. A method in accordance with claim 8, wherein the external solubilizing agent is benzyl alcohol.

* * * * *